US006527675B1

(12) United States Patent
Yu

(10) Patent No.: US 6,527,675 B1
(45) Date of Patent: Mar. 4, 2003

(54) ILLUMINATING HAND-SHAKING EXERCISER WITH TRIPLE ROTATING AXLE

(75) Inventor: Hui-Nan Yu, Taoyuan (TW)

(73) Assignee: Jao-Hsing Tsai, Hsinchu (TW)

( * ) Notice: Subject to any disclaimer, the term of this patent is extended or adjusted under 35 U.S.C. 154(b) by 0 days.

(21) Appl. No.: 10/023,661

(22) Filed: Dec. 21, 2001

(51) Int. Cl.[7] ..... A63B 21/22
(52) U.S. Cl. ..... 482/44; 482/110; 601/107
(58) Field of Search ..... 482/44, 110, 45, 482/46, 49, 50, 148; 472/137; 446/233, 266; 601/107

(56) References Cited

U.S. PATENT DOCUMENTS 609,444 A * 8/1898 Lewis ..... 184/45.1
5,766,112 A * 6/1998 Chuan ..... 482/44
5,800,311 A * 9/1998 Chuang ..... 482/44
6,053,846 A * 4/2000 Lin ..... 482/44
6,241,637 B1 * 6/2001 Basyuk ..... 482/44

* cited by examiner

*Primary Examiner*—Stephen R. Crow
(74) *Attorney, Agent, or Firm*—Troxell Law Office PLLC

(57) ABSTRACT

An illuminating hand-shaking exerciser with a triple rotating axle mainly comprises a main shell having internal rotary collars connected to shells by an axle. When two semi-spherical covers of two sets of matching shells are closed against each other, a space is provided for internal rotary collars. One shell holds several lighting coils. The internal rotary collars are placed in the order of large, medium and small collars. The small collar has a groove at inner edge to lock an inertial magnetic weight inside. When the user grasps the shell and shakes it around, the large, medium and small collars will rotate three-dimensionally. Further, due to inertial rotation by the inertial magnetic weight inside the small collar, the entire exerciser will shake vigorously. Meanwhile, the lighting coils will illuminate due to inertial rotation of the magnet. Thus, the exerciser provides hand exercise with entertaining effect of illumination.

3 Claims, 6 Drawing Sheets

ILLUMINATING HAND-SHAKING EXERCISER WITH TRIPLE ROTATING AXLE

FIELD OF THE INVENTION

The present invention is related to an illuminating hand-shaking exerciser with a triple rotating axle, particularly, a hand-shaking exerciser that has internal rotary collars capable of three-dimensional rotation and illumination.

BACKGROUND OF THE INVENTION

Among various kinds of leisure activities, indoor body-building exercise has become widely accepted. No matter in a bodybuilding exercise room or at home, almost all kinds of exercise equipment can be used in leisure time for the purpose of bodybuilding. However the bodybuilding equipment has both complicated structure and expensive cost. Further, the equipment has a rather large size that would result in disadvantages such as waste of space during placement or storage.

In view of this and based on the need of a bodybuilding equipment that can be used in leisure time, the inventor for the present invention has achieved an illuminating hand-shaking exerciser with internal rotary collars after very careful thought and accumulation of many years of experience in research and development.

SUMMARY OF THE INVENTION

The main objective of the present invention is to provide an illuminating hand-shaking exerciser with a triple rotating axle in a design that adopts internal rotary collars to make three-dimensional rotation and illumination, which further provides benefit of exercise with entertainment.

Another objective of the present invention is to provide an illuminating hand-shaking exerciser with a triple rotating axle that is small, capable of easy handling and simple operation, so in leisure time the users can casually and conveniently make hand exercise with it.

According to the above-mentioned objectives, technical means and structural characteristics, a detailed description is specifically given below with references of attached figures.

DETAILED DESCRIPTION OF THE INVENTION

Figure 1:
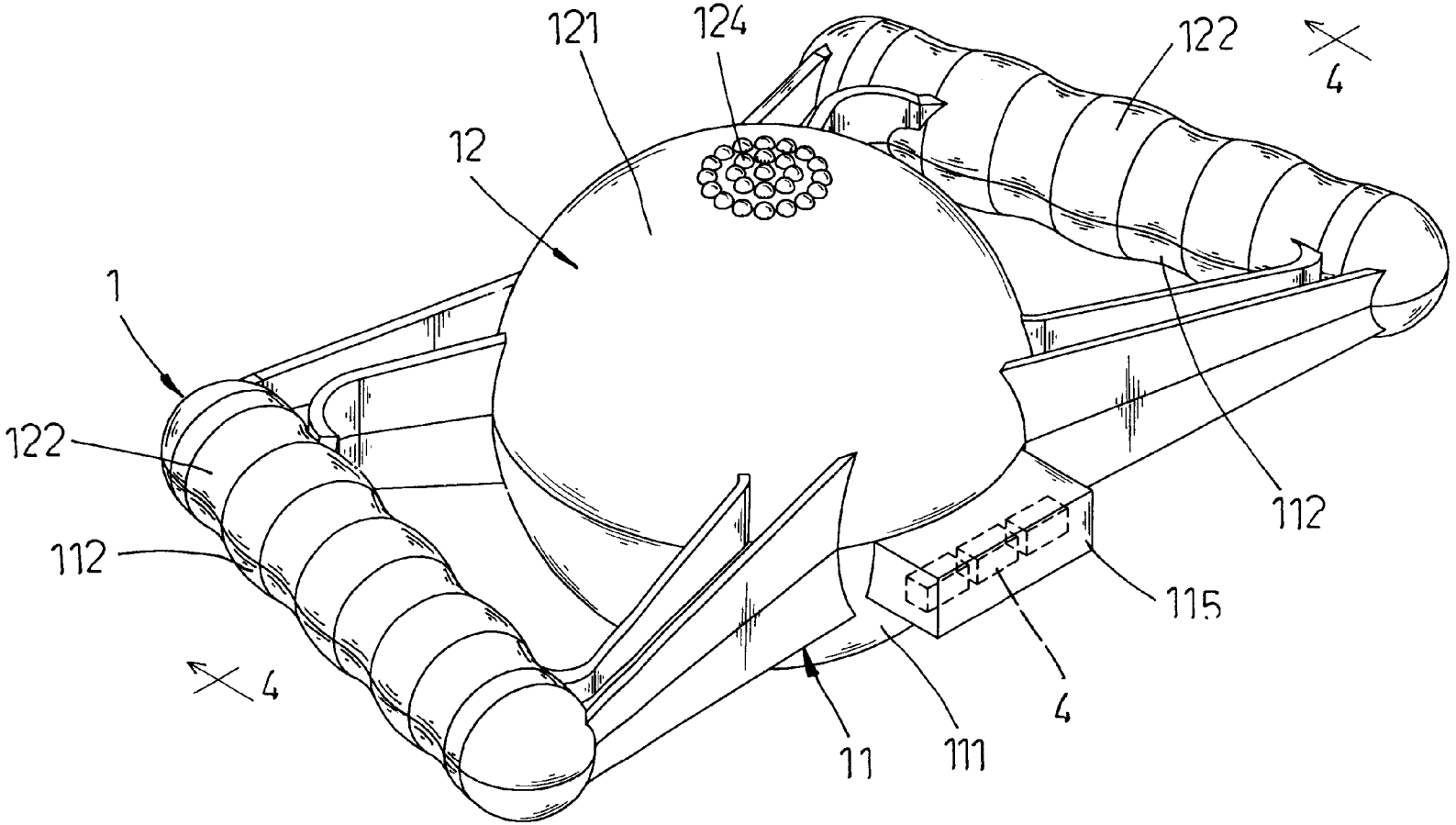
FIG. 1 is a three-dimensional appearance for the present invention.
Figure 2:
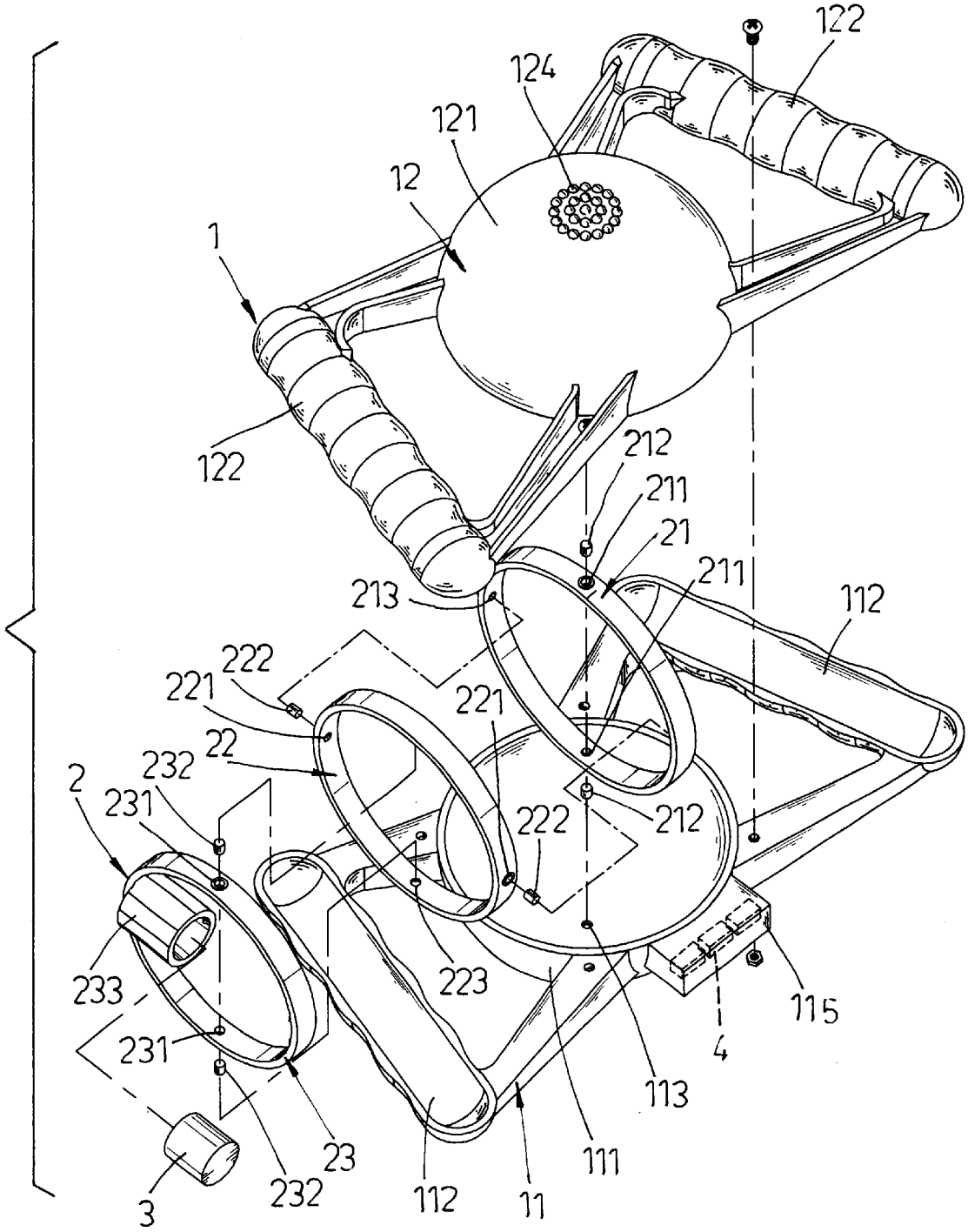
FIG. 2 is a structural decomposition for the present invention.
Figure 3:
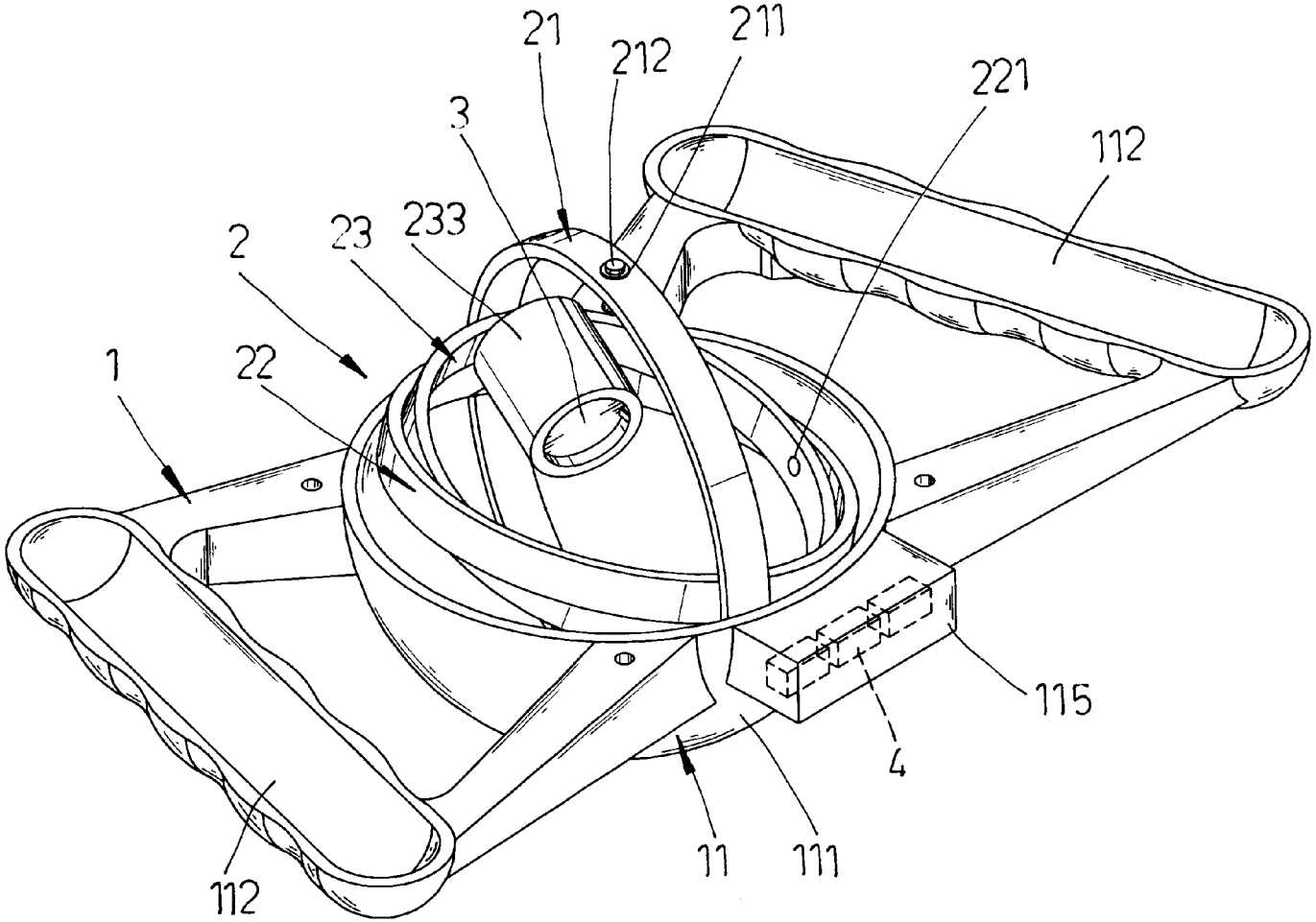
FIG. 3 is a structure and status of operation for the internal rotary collars for the present invention.

Please refer to FIGS. 1 to 3. The present invention is mainly formed by connecting a shell 1 with internal rotary collars 2 at axle. The shell 1 is formed by combining two matching shells 11, 12. The matching shells 11, 12 are in butterfly shape that is formed by two semi-spherical covers

111, 121 and handles 112, 122 of their extension. The semi-spherical covers 111, 121 of the matching shells 11, 12 have pivot holes 113, 123 at the center of inner edge and convex beads 114, 124 at center of the outer surface. The semi-spherical cover 111 of the matching shell 11 has a holder 115 for placing and positioning a magnet 3 or the above-mentioned lighting coils 4.

The above-mentioned internal rotary collars 2 are formed in order by a large collar 21, a medium collar 22 and a small collar 23. The large collar 21 is positioned by pivots 212 through passages 211, so that the two pivots protrude beyond the outer edge of the large collar 21 and connect to the pivot holes 113, 123 on the semi-spherical covers 111, 121 of the matching shells 11, 12 for the main shell 1. As a result, the large collar 21 can rotate inside the space created by closing the two semi-spherical covers 111, 121 for the main shell 1. Further, the large collar 21 has two pivot holes 213 at the position perpendicular to the pivots 212 on inner edge, which are used to connect to the medium collar 22 with two corresponding passages 221 and pivots 222. The two pivots 222 protrude beyond the outer edge of the medium collar 22 and insert into the pivot holes 213 on the large collar 21, so the medium collar 22 can rotate in the large collar 21. The small collar 23 has two corresponding passages 231 and pivots 232 that protrude beyond the outer edge of the small collar 23 and connect with the medium collar 22 through the pivot holes 223. So the small collar 22 can rotate in the medium collar 21.

Figure 4:
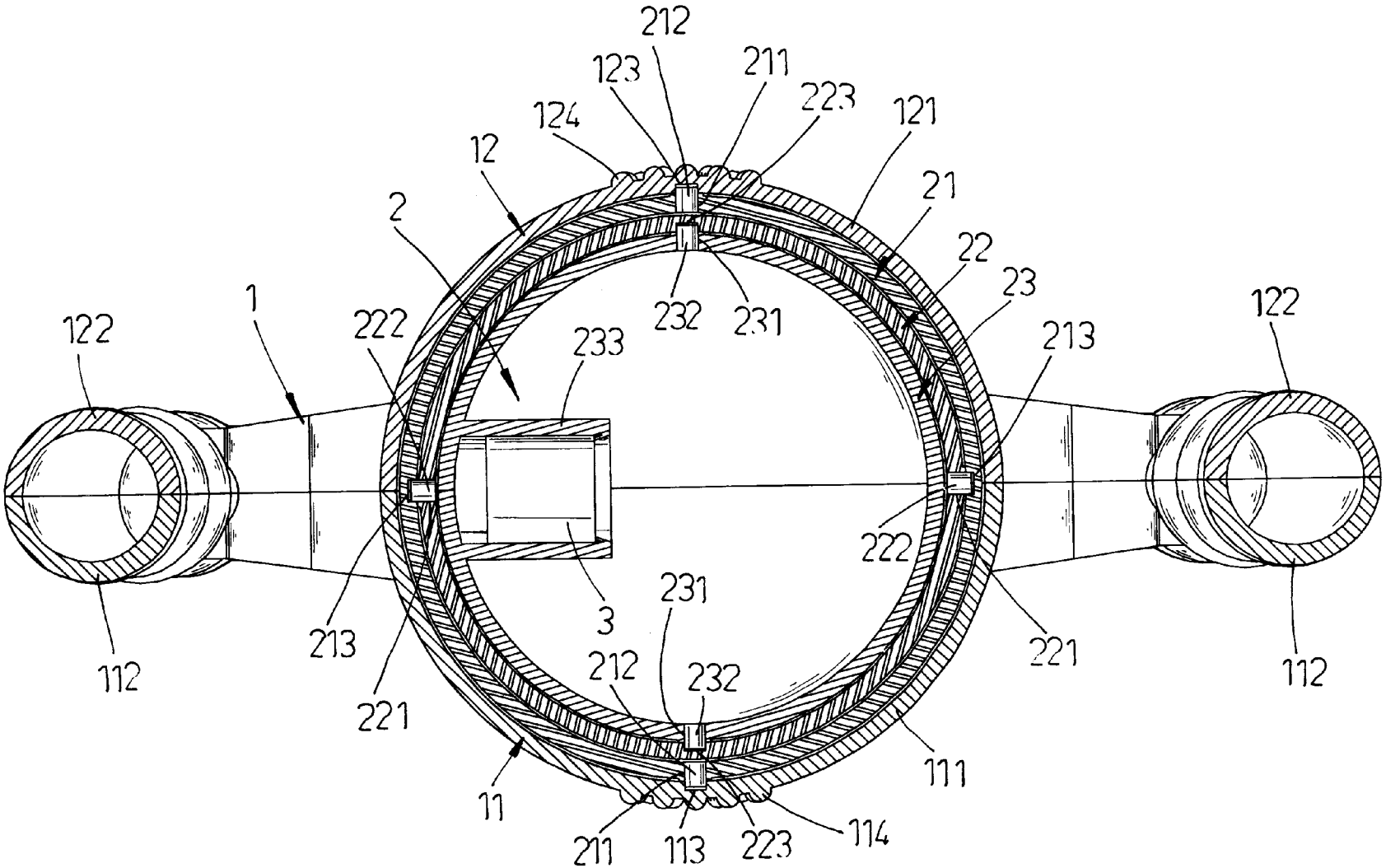
FIG. 4 is a cross-sectional view for the present invention.
Figure 5:
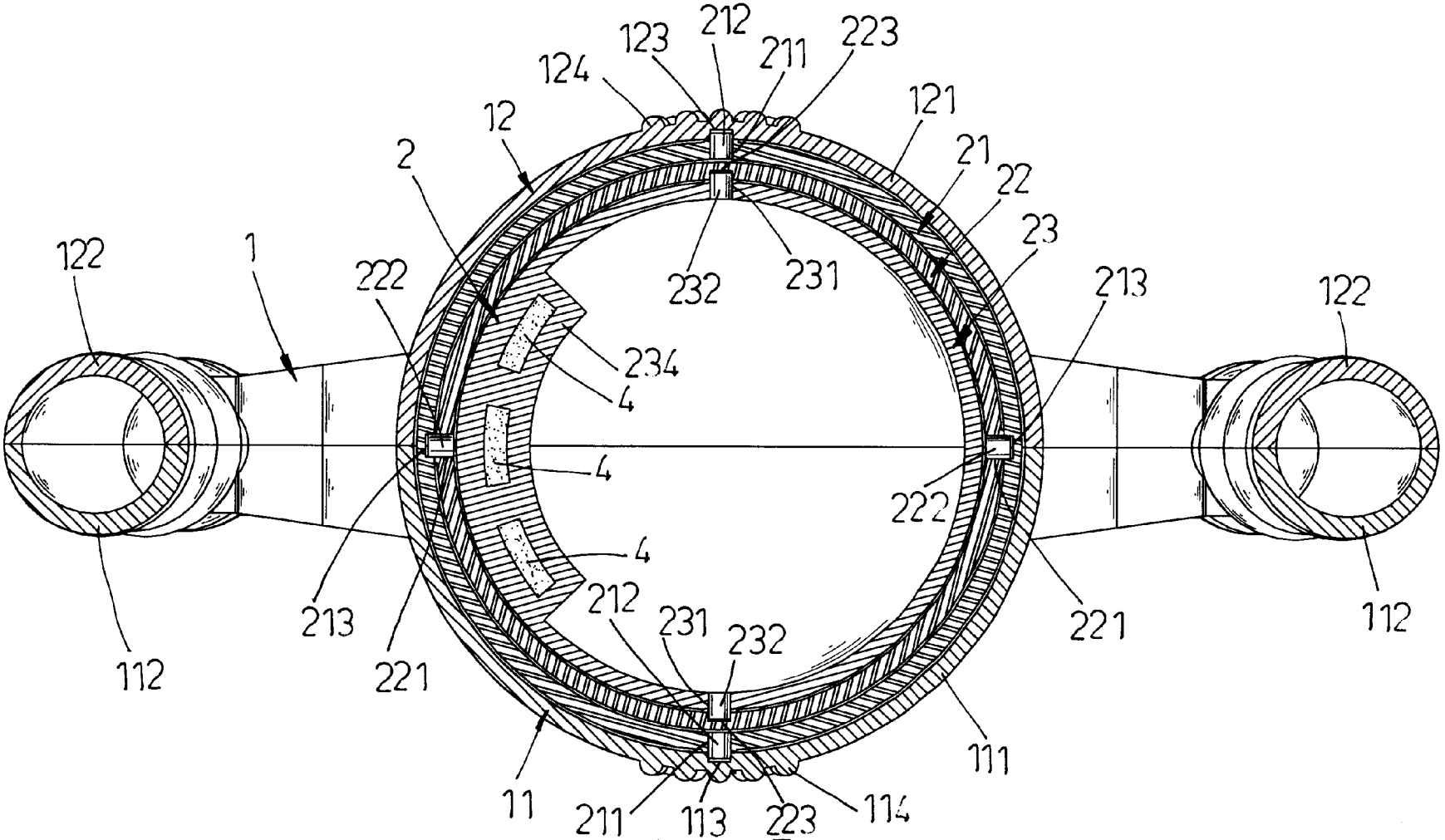
FIG. 5 is a cross-sectional view for another embodiment for the present invention.
Figure 6:
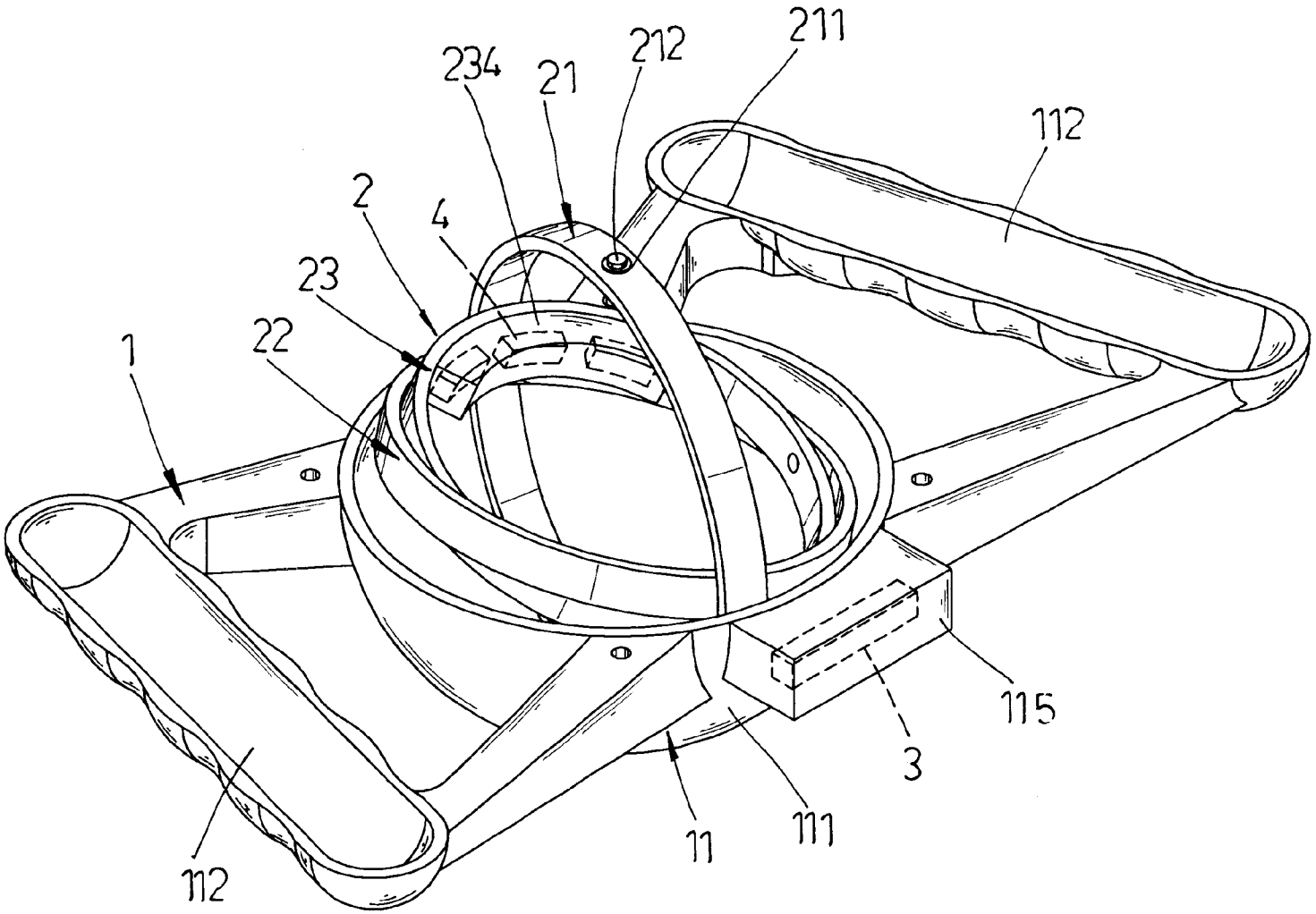
FIG. 6 is a status of operation for another embodiment for the present invention.

Further, the above-mentioned small collar 23 has an inertial weight on the inner surface, which can be a magnet 3 or lighting coils 4. If the inertial weight is a magnet 3, a groove 233 can be installed on the inner surface of the small collar 23 for locking the magnet 3 (as shown in FIG. 4), which corresponds to the lighting coils 4 (as shown in FIG. 3) in the holder 115 of the above-mentioned matching shell 11. If the inertial weight is lighting coil 4, the small collar 23 can further has a gravitational weight 234 on inner surface for incorporating several lighting coils 4 (as shown in FIG. 5), which corresponds to the magnet 3 (as shown in FIG. 6) in the holder 115 of the above-mentioned matching shell 11. Thus, when the small collar 23 rotates to position the magnet 3 to the lighting coil 4, the lighting coil 4 will light.

It is known from the above that the large collar 21, the medium collar 22 and the small collar 23 in order can be connected to the two semi-spherical covers 111, 121 for the main shell 1 to rotate within the internal space. Besides, the small collar 23 has an inertial weight on the inner surface. When the user grasps the two handles 112, 122 of the main shell 1 by hands and rotate the exerciser around a circle, the large collar 21, the medium collar 22 and the small collar 23 in the main shell 1 can make three-dimensional rotation. Further, the inertial weight in the small collar 23 produces an inertial rotation when the user rotates the exerciser. As a result, a vibrational effect is given to the entire exerciser. This is in accordance with the convex beads 114, 124 at the center of the outer surface of the two semi-spherical covers 111, 121 for the main shell 1 to achieve a massaging effect. Further, the interaction between the magnet 3 and the lighting coil 4 in the main shell 1 is used for the lighting coil to light. No matter it is the inertial rotary magnet 3 to be positioned to the lighting coil 4 or the stationary magnet 3 to be positioned to the lighting coil 4, the exerciser can make the lighting coil 4 to generate attractive light of entertaining effect. Therefore, the present invention in practical application can combine a massaging effect on hand exercise with entertaining effect of illumination, so it certainly has the features in both progressiveness and practical use.

What is claimed is:

1. An illuminating hand-shaking exerciser with a triple rotating axle, mainly comprising a main shell having internal rotary collars connected to shells by an axle and characterized by:

said main shell formed by two sets of matching shells having semi-spherical covers extended outward to form handles, and inside the semi-spherical covers, there being non-through pivot holes, and one semi-spherical cover having a holder for accommodating several lighting coils;

said internal rotary collar composed of a large collar, a medium collar and a small collar in order, said axle positioned along an outer edge through two corresponding pivot holes and pivots, said lager collar connecting to said semi-spherical cover through said pivots and said pivot holes, further, on inner surfaces of said large collar and said medium collar, there being non-through pivot holes corresponding perpendicularly for said medium collar and said small collar to connect in order, therefore, said large collar being able to rotate within said two semi-spherical covers for said main shell while said medium collar rotating within said large collar and said small collar rotating within said medium collar, and a groove installed on an inner surface of said small collar for holding inertial magnetic weight; and through above arrangement, when a user grasping said handle and rotating said exerciser around a circle, said large collar, medium collar and small collar inside said main shell being able to make three-dimensional rotation, in addition, because of a magnetic inertial weight installed inside said small collar, an inertial rotation being generated to give a vibrational effect to said entire exerciser, moreover, said lighting coil inside said main shell being able to give off light when it being positioned to a corresponding inertial magnet, so said exerciser being able to provide a combinative effect of hand exercise and lighting entertainment.

2. The illuminating hand-shaking exerciser with a triple rotating axle of claim 1, wherein there are several convex beads around the center of an outer surface of said two matching shells for said small collar inside said main shell to make inertial rotation and achieve massaging effect.

3. The illuminating hand-shaking exerciser with a triple rotating axle of claim 1, wherein a holder within said semi-spherical covers can be further replaced by positioning of said magnet, on the inner surface of said collar, a gravitational weight can be further added for holding several lighting coils, which will be positioned to said corresponding magnet to give off light during inertial rotation.

* * * * *